United States Patent [19]

Roccaforte

[11] 4,236,662

[45] Dec. 2, 1980

[54] CONTAINER HAVING AN INTERNAL SUPPORT PLATFORM AND BLANK THEREFOR

[75] Inventor: Harry I. Roccaforte, Western Springs, Ill.

[73] Assignee: Champion International Corporation, Stamford, Conn.

[21] Appl. No.: 28,222

[22] Filed: Apr. 9, 1979

[51] Int. Cl.[3] ..... B65D 5/50; B65D 5/10

[52] U.S. Cl. ..... 229/39 B; 229/48 SB

[58] Field of Search ..... 226/39 B, 39 R, 48 SB

[56] References Cited

U.S. PATENT DOCUMENTS

| | | | |
|---|---|---|---|
| 1,039,026 | 9/1912 | Carter | 229/39 B |
| 2,397,041 | 3/1946 | Pamtalone | 229/39 B X |
| 2,399,537 | 4/1946 | Beldem | 229/39 B X |
| 2,438,879 | 3/1948 | Whitehead | 229/39 B |
| 2,537,151 | 1/1951 | Mires | 229/39 B |
| 3,272,421 | 9/1966 | Perry | 229/39 R |
| 3,305,079 | 2/1967 | Bowman et al. | 229/39 R X |
| 3,735,918 | 5/1973 | Tumdermann | 229/485 B X |
| 3,770,187 | 11/1973 | Faires et al. | 229/39 R |

FOREIGN PATENT DOCUMENTS

| | | | |
|---|---|---|---|
| 209618 | 1/1924 | United Kingdom | 229/39 B |

*Primary Examiner*—Davis T. Moorhead

*Attorney, Agent, or Firm*—Evelyn M. Sommer

[57] ABSTRACT

A multi-sided container, formed of a unitary blank, defining an enclosed chamber in which a platform is located. The platform is coupled to one of the outer panels of the container and has an article receiving aperture therein. The platform is formed from a series of hingedly connected panels, one of which is integral with one of the container's outer panels and the other of which is adhered to that same outer panel. In one embodiment, the platform is integral with an outer side panel. In another, the platform is integral with an outer front panel. The platform is perpendicular to the outer panel to which it is coupled. The container is formed from the blank in only three folding steps.

26 Claims, 21 Drawing Figures

CONTAINER HAVING AN INTERNAL SUPPORT PLATFORM AND BLANK THEREFOR

The present invention relates to a container, formed of a unitary blank of paper board or cardboard, having an internal platform for supporting an article inside the chamber formed by the panels of the container. The container is specifically adapted for supporting light bulbs. The invention also relates to the configuration of the unitary blank forming the container.

Fragile articles such as small light bulbs, including those used in motion picture and slide projectors, are difficult and expensive to package. Specifically, if a regular carton having essentially the same size as the bulb is utilized, then depressions of the outer walls of the carton can cause breakage of the fragile bulb. If extra protective packing material, such as foam, is utilized inside the carton, this increases the cost of packaging with regard to materials and with regard to the manual labor required to pack the bulb. Similarly, if various additional separate pieces of cardboard or paper board are interposed inside the carton to add support to the bulb, this also adds material and labor costs. In addition, many of these types of cartons can not be automatically erected by high speed machines.

Accordingly, it is a main object of the present invention to overcome the limitations and drawbacks associated with the known containers for such things as fragile articles and to provide a new and improved container with an integrally formed internal support platform.

Another object of the present invention is to provide a container having an integrally formed internal platform in which the container is formed from a unitary blank of material, such as paper board or cardboard.

Another object of the present invention is to provide such a container in which the basic container forming steps can be performed automatically by high speed machines, including only three folding steps.

Another object of the present invention is to provide such a container in which the integrally formed platform has an article receiving aperture therein for supporting the article in substantially the center of the set-up container so that it is spaced from the walls thereof.

The foregoing objects are basically attained by providing a container having an internal platform for supporting an article comprising a front panel, first and second side panels, and a rear panel hingedly coupled along generally parallel fold lines to define an enclosed chamber; a glue flap interconnecting the rear panel and one of the side panels; a top closure formed of at least one top closure flap hingedly extending from the top of one of the side panels and extending perpendicular thereto; a bottom closure formed of at least one bottom closure flap hingedly extending from the bottom of one of the panels and extending perpendicular thereto; a platform located in the chamber; and means for coupling the platform to one of the panels, this platform having means defining an article receiving aperture therein.

More specifically, the platform is formed of a series of four consecutively arranged platform panels, the first of which is integrally and hingedly connected to one of the side or front panels of the container. This series comprises a first platform panel hingedly extending from one of the front and side panels, a second platform panel hingedly extending from the first platform panel, a main platform panel hingedly extending from the second platform panel and having the article receiving aperture therein, and a third platform panel hingedly extending from the main platform panel, this third platform panel being adhered to the panel from which the series first extends. When erected, the article receiving aperture is substantially in the middle of the container so as to support the article in a position, advantageously, slightly spaced from the walls of the container.

A first embodiment of the blank and container in accordance with the present invention is shown in FIGS. 1–7, in which the series of platform panels extend from a side panel forming the container. In this embodiment, a locking flap is used to close the bottom of the container. The article receiving aperture is substantially rectangular.

In FIG. 8, the blank is substantially the same as in FIGS. 1–7; however, the article receiving aperture extends across two platfrom panels and has a configuration suitable for receiving a bulb base which has a sidewise protruding projection.

In FIG. 9, the blank is substantially the same as in FIGS. 1–7; however, the article receiving aperture has six sides and has a plurality of foldable tabs extending inwardly from three of the sides to aid in grasping the base of a light bulb which has a prong or projection thereon.

A modified embodiment of the blank and container is shown in FIGS. 10–21 and has the series of platform panels extending from the front panel thereof. In all of these figures, the article receiving aperture is substantially rectangular.

In FIGS. 10–15, the bottom closure flap extending from the rear panel has adhesive thereon to close the bottom of the container.

In FIGS. 16–18, the blank is substantially the same as in FIGS. 10–15; however, the bottom closure flap on the rear panel has a lock tab receivable in a cut line in the first panel in the series of platform panels.

In FIGS. 19–21, the blank is substantially the same as in FIGS. 10–15; however, the bottom closure flap extending from the rear panel is an isosceles trapezoid with an end receivable in a cut line in the first platform panel in the series of platform panels.

Other objects, advantages and salient features of the present invention will become apparent from the following detailed description which, taken in conjunction with the annexed drawings, discloses preferred embodiments of the present invention.

Referring to the drawing which form a part of this original disclosure;

Figure 1:
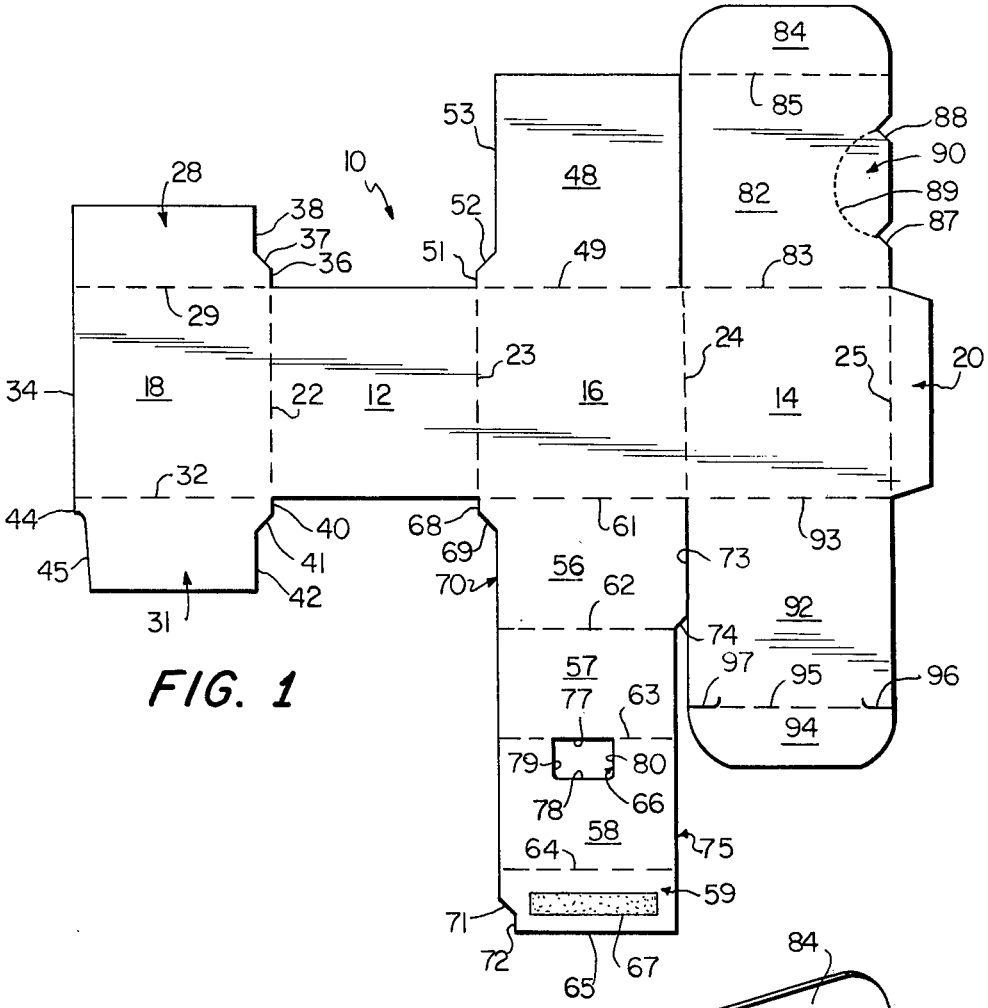
FIG. 1 is a side elevational view of the inside surface of the blank in accordance with the present invention with dashed straight lines indicating fold lines.
Figure 4:
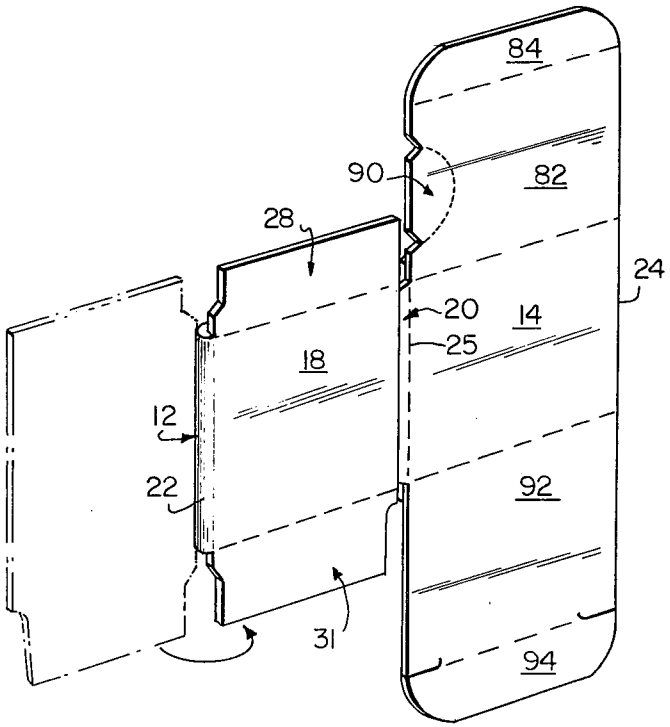
FIG. 4 is a right perspective view of the blank shown in FIG. 3, except that the second side panel and its top and bottom closure flaps have been folded from a position shown in solid lines in FIG. 3 and in phantom lines in FIG. 4 to a position shown in solid lines overlying the glue flap extending from the rear panel and overlying the front panel.
Figure 5:
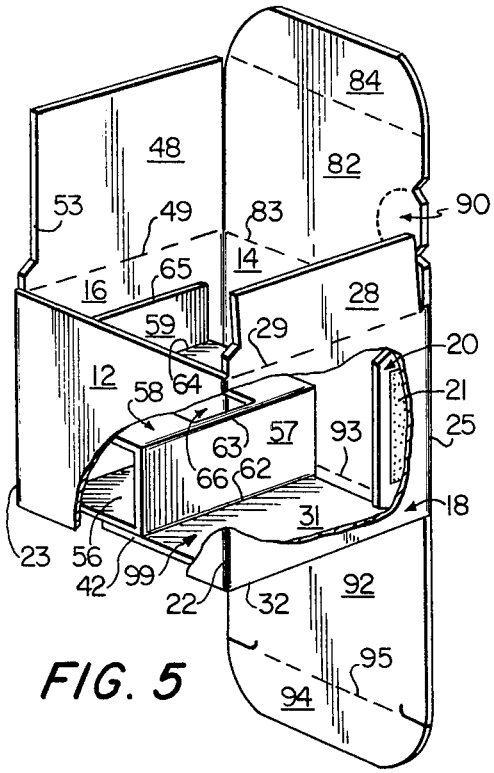
Figure 6:
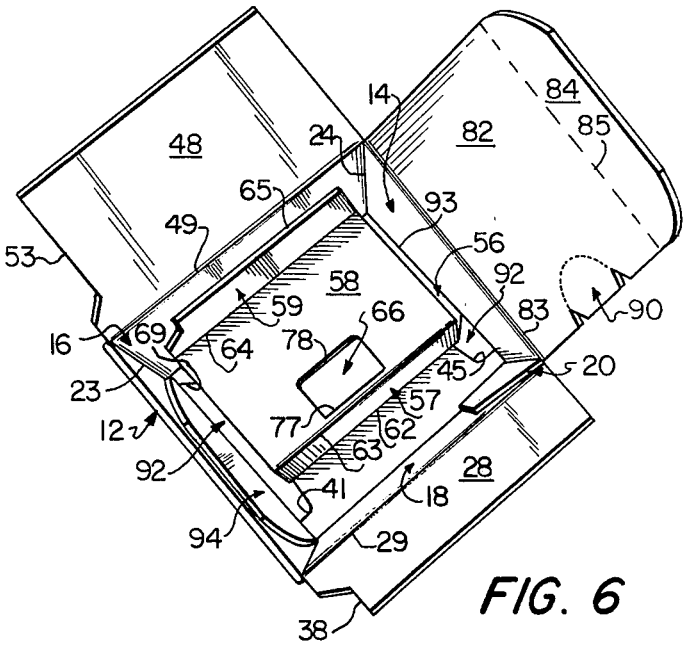
Figure 7:
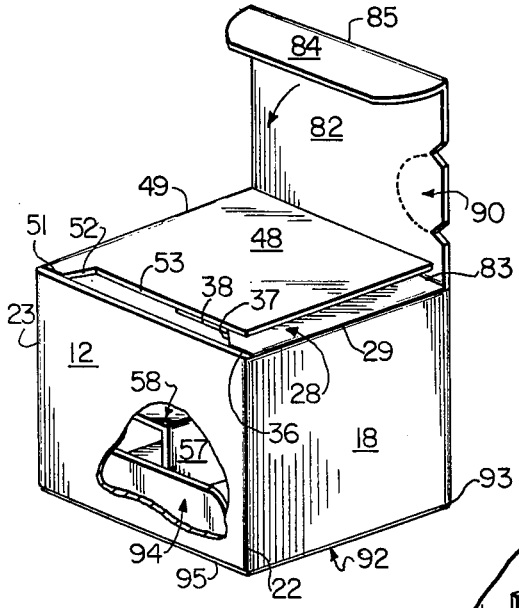
Figure 8:
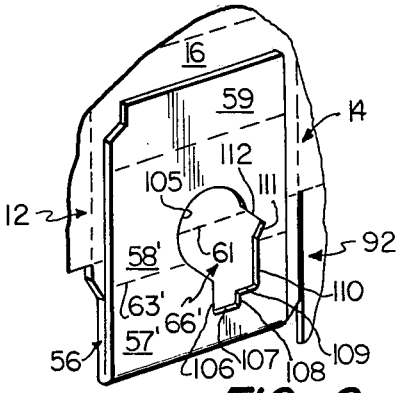
Figure 9:
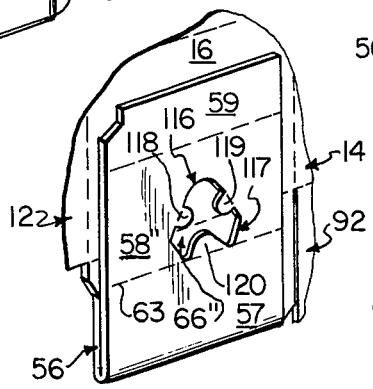
Figure 10:
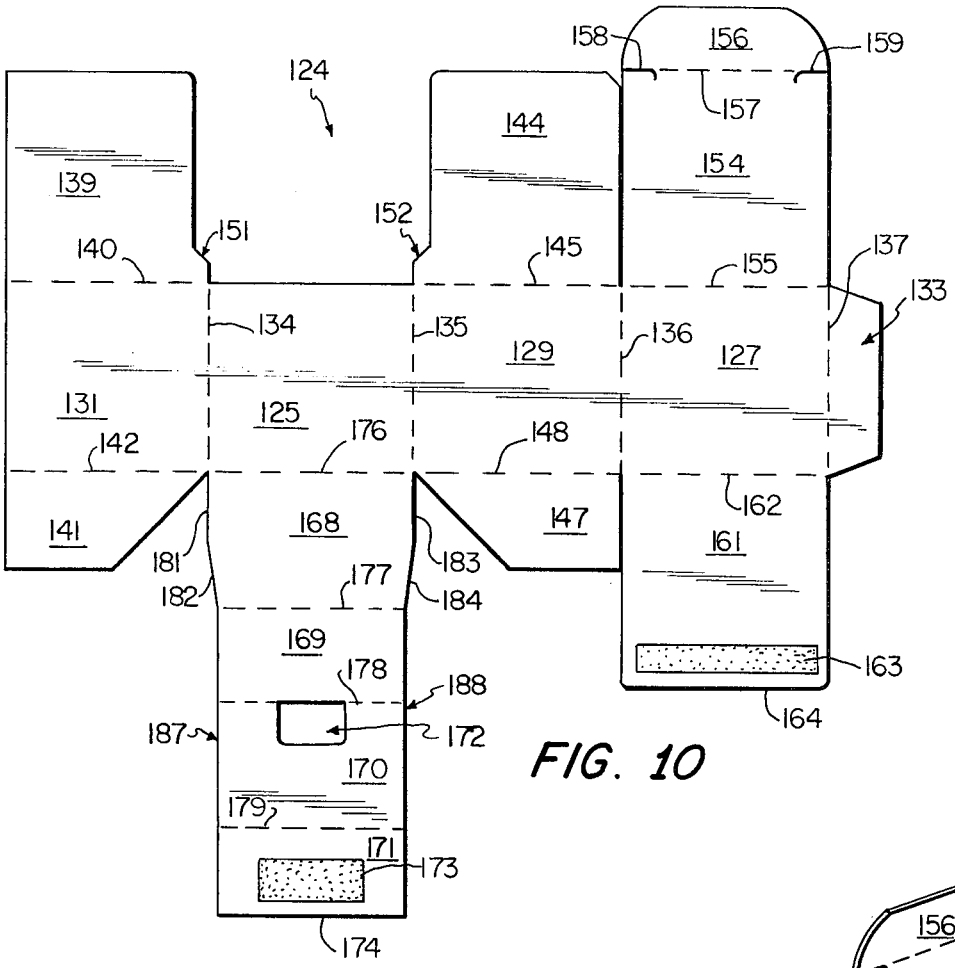
Figure 11:
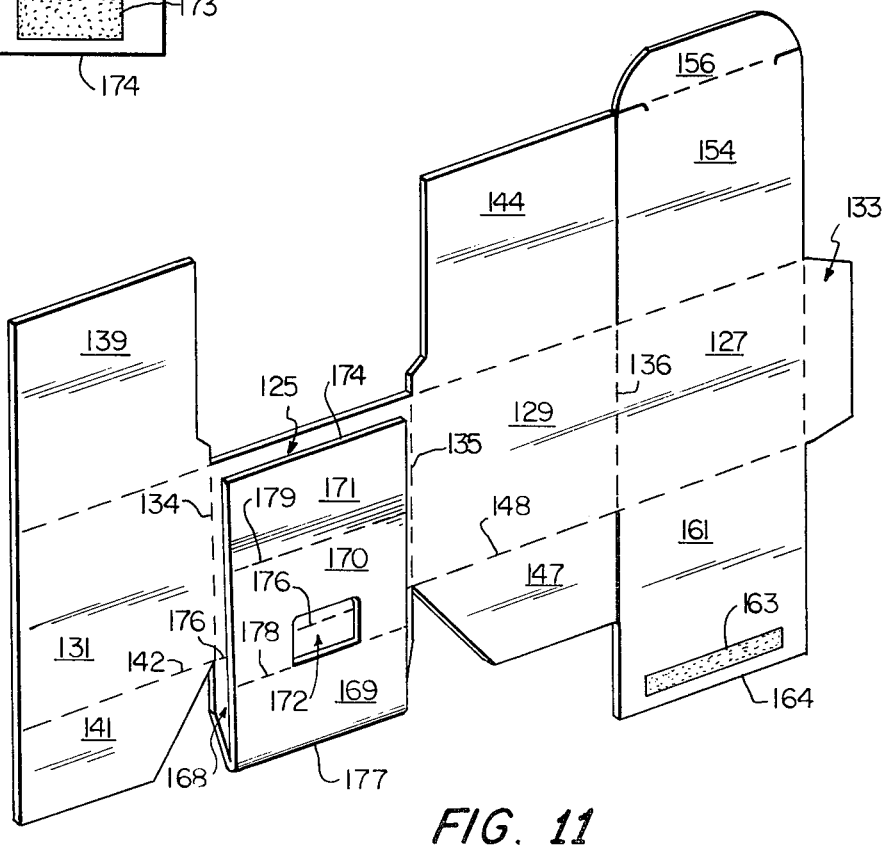
Figure 12:
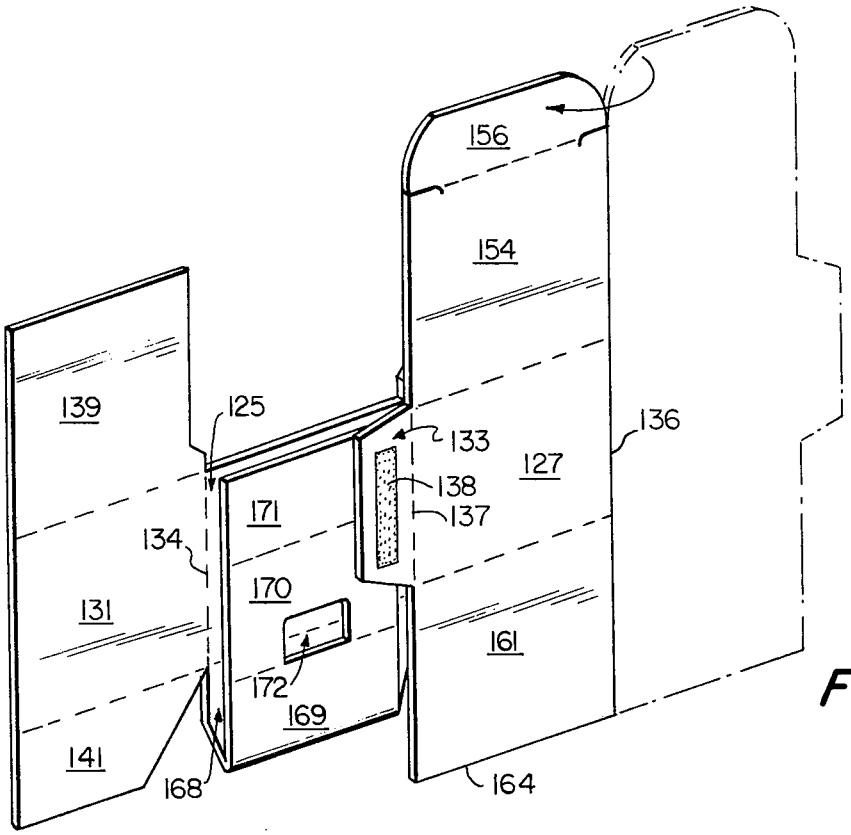
Figure 13:
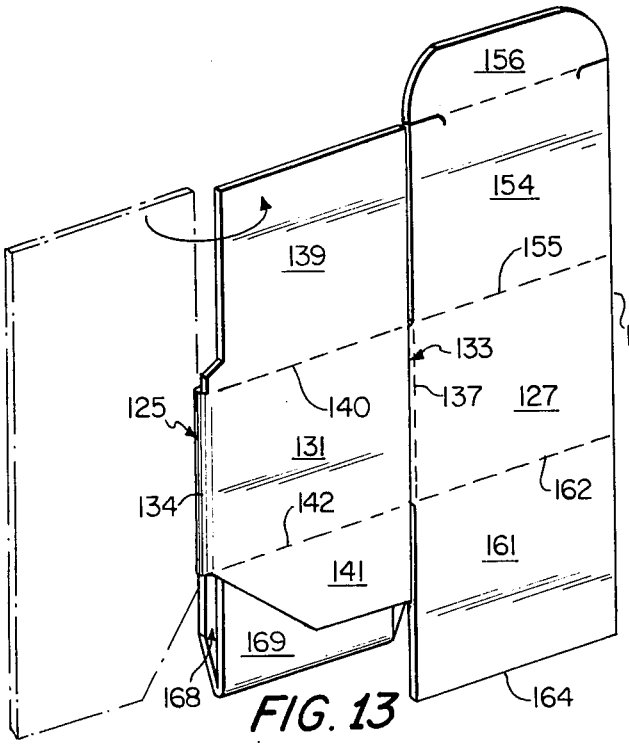
Figure 14:
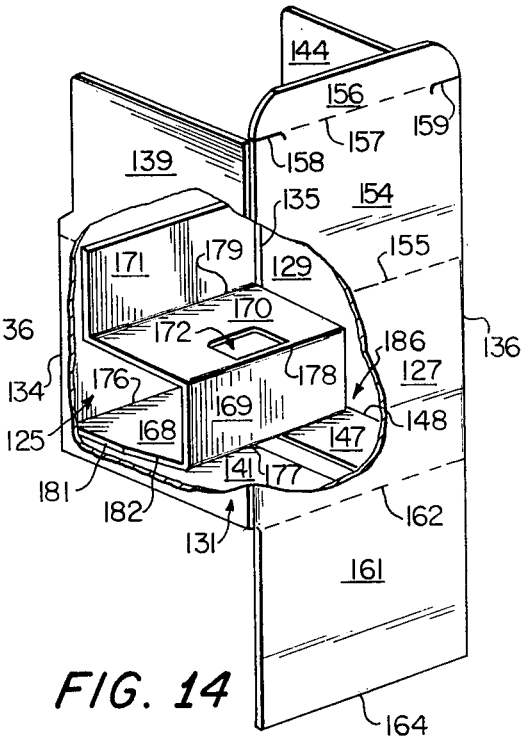
Figure 15:
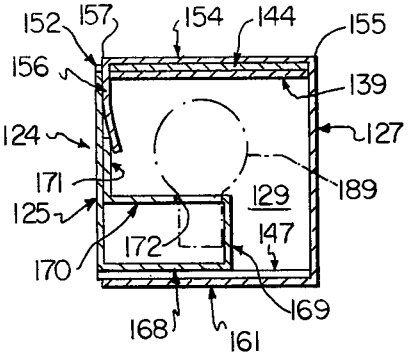
Figure 17:
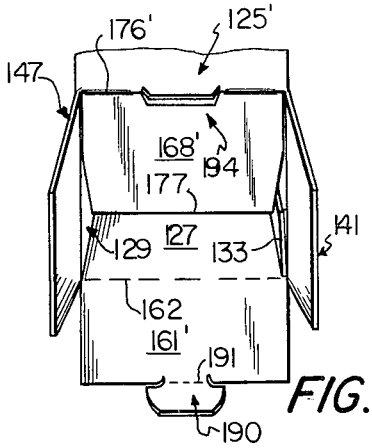
Figure 18:
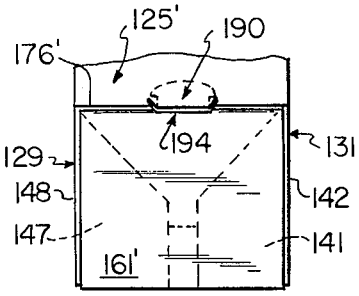
Figure 16:
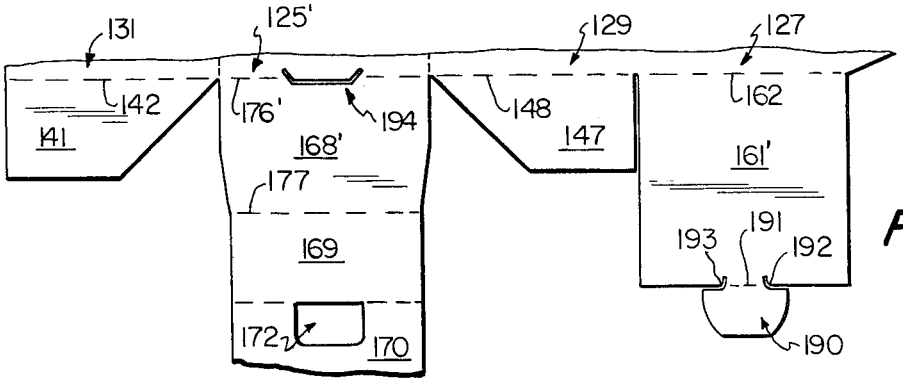
Figure 19:
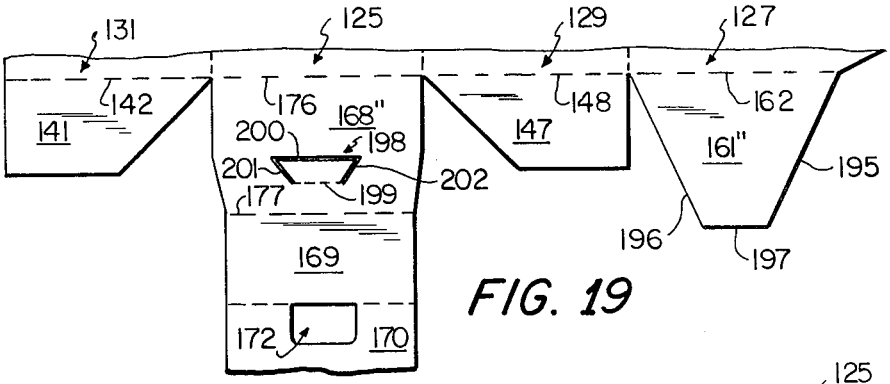
Figure 20:
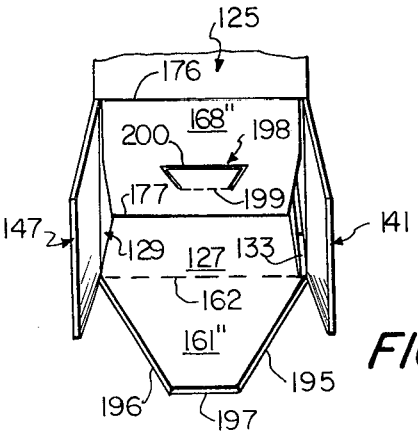
Figure 21:
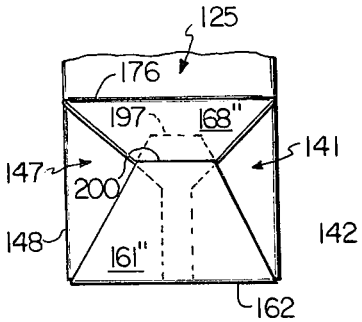

FIG. 5 is a right perspective view in elevation, with parts cut away, showing the flat sleeve as depicted in FIG. 4 expanded into a rectangular cross section and with the platform panels being pushed upwards so that the main platform panel is substantially perpendicular to the side panel from which it extends and with the bottom closure flap extending from the second side panel having been folded perpendicular thereto and into contact with the bottom of the first platform panel;

FIG. 6 is a top perspective view showing the set-up container seen in FIG. 5, but with the bottom closure flap extending perpendicular to the rear panel and being locked in the closed position;

FIG. 7 is a right perspective view in elevation, with parts cut away, showing the container as seen in FIG. 6 with the top closure flaps in the folded position and with the tuck flap on the top closure panel associated with the rear panel about to be closed;

FIG. 8 is a right fragmentary perspective view of a modified article receiving aperture formed in a blank shown in FIG. 1;

FIG. 9 is a right fragmentary perspective view showing another modified article receiving aperture formed in the blank shown in FIG. 1;

FIG. 10 is a side elevational view of the inside surface of a modified blank in accordance with the present invention in which the series of platform panels extend from the front panel thereof and the outermost bottom closure flap as adhesive thereon, the dashed straight lines indicating fold lines;

FIG. 11 is a right perspective view of the blank shown in FIG. 10 except that the second, main and third platform panels have been folded into a position overlying the front panel and in which adhesive has been interposed between the front panel and the third platform panel;

FIG. 12 is a right perspective view of the blank shown in FIG. 11, except that the rear panel and its top and bottom closure flaps have been folded from a position shown in solid lines in FIG. 11 and phantom lines in FIG. 12 to a position shown in solid lines overlying the first side panel and in which the glue flap overlies the series of platform panels, adhesive being added to the glue flap;

FIG. 13 is a right perspective view of the blank shown in FIG. 12, except that the second side panel and its top and bottom closure flaps have been folded from a position shown in FIG. 12 in solid lines and in FIG. 13 in phantom lines to a position shown in solid lines in which the side panel contacts the glue flap and overlies the platform panels;

FIG. 14 is a perspective view, with parts cut away of the blank shown in FIG. 13 in which the flat sleeve has been expanded into a rectangular cross section, with the platform panels being pushed upwards so that the main platform panel is perpendicular to the front and rear panels and with the bottom closure flaps associated with the side panels being folded inwardly into a contacting relationship with the bottom of the first platform panel;

FIG. 15 is a longitudinal sectional view in right side elevation showing the container of FIG. 14 with all of the closure flaps being in their closed position and in which an article received in the container is shown in phantom lines;

FIG. 16 is a fragmentary side elevational view of the inner surface of the blank shown in FIG. 10, except that the outermost bottom closure flap has a lock tab thereon and a cut line is provided in the first platform panel;

FIG. 17 is a bottom fragmentary perspective view of the container formed from the blank shown in FIG. 16 with the bottom closure flaps extending downwardly from the panels to which they are hingedly connected;

FIG. 18 is a bottom fragmentary perspective view of the container shown in FIG. 17 in which the bottom closure flap having the lock tab thereon has been folded so that the tab is received in the cut line and the container bottom closed;

FIG. 19 is a fragmentary side elevational view of the inner surface of the blank shown in FIG. 10, except that the bottom closure flap associated with the rear panel has an isosceles triangular configuration and the first platform panel has a cut line for receiving that flap;

FIG. 20 is a bottom fragmentary perspective view of a container formed from the blank shown in FIG. 19 with the bottom closure flaps extending downwardly from the panels to which they are hingedly connected; and FIG. 21 is a bottom fragmentary perpective view of the container shown in FIG. 20 with the bottom closure flap being received in the cut line so that the container is closed at the bottom.

Referring now to the drawings in further detail, the unitary blank 10 shown in FIG. 1 is preferably formed of thin, foldable paper board or cardboard. The blank is comprised of a front panel 12, a rear panel 14, a first side panel 16 and a second side panel 18, all of which are rectangular and are hingedly connected at their sides respectively along parallel fold or hinge lines 22, 23 and 24. These fold lines are preferably formed in the blank 10 by means of a light scoring of the paper board or cardboard. In addition, a glue flap 20 hingedly extends along fold line 25 from the distal edge of the rear panel 14. Fold line 25 is parallel to fold lines 22, 23 and 24. This glue flap is tapered. Of course, the glue flap could also extend from the distal or exterior edge of the second side panel 18. Panels 12, 14, 16 and 18 have the same length, which is the vertical distance shown in FIG. 1.

The first side panel 16 and the second side panel 18 are on opposed sides of the front panel 12, the sides being defined by fold lines 22 and 23. The rear panel 14 hingedly extends along fold line 24 from the first side panel 16. The width and length of the two side panels are the same, and the width and length of the front and rear panels are the same.

The second side panel 18 has a top closure flap 28 hingedly extending along fold line 29 at the top of panel 18 and has a bottom closure flap 31 hingedly extending along fold line 32 at the bottom of panel 18. The free, exterior edge of the second side panel is designated 34. The edge of the top closure flap 28 adjacent front panel 12 is recessed along recessed edge 38 to provide a locking flange defined by edge 36 which is a continuation of fold line 22 and edge 37 which extends between edges 36 and 38 at an angle of about 135°. Edges 36 and 38 are parallel and edge 37 extends about half way along the length of flap 28.

The bottom closure flap 31 is similarly recessed on the edge adjacent front panel 12 forming a locking flange bordered by edges 40 and 41, edge 40 being an extension of fold line 22, edge 41 extending at about an angle of 135° from edge 40 and recessed edge 42 extending downwardly parallel to edge 40. The locking flange has a size and configuration similar to that defined on flap 28; however, the length of the flap is larger. In addition, flap 31 is also recessed on the edge below free edge 34 of the second side panel and includes a locking flange defined by short, straight edge 44 as a continuation of edge 34 and recessed edge 45 which extends to the bottom edge of flap 31 and curves into contact with edge 44.

The first side panel 16 has a top closure flap 48 hingedly extending along fold line 49, this closure flap having substantially a rectangular configuration except it has a recess on the edge adjacent front panel 12 defined by recessed edge 53 extending from the top thereof to a short edge 52 at an angle of about 135° with edge 53. Edge 52 extends into a short edge 51, which is at about 135° to edge 52 and which is an extension of fold line 23. Thus, edges 51 and 52 define a locking flange for flap 48.

A series of four consecutively arranged platform panels are hingedly connected along parallel fold lines and extend from the bottom of the first side panel 16. Specifically, there is a first platform panel 56, a second platform panel 57, a main platform panel 58 and a third or support platform panel 59. Panel 56 hingedly extends from the bottom of the first side panel 16 along fold line 61, the second platform panel 57 hingedly extends along fold line 62, which can have a central cut therein, from the bottom of the first platform panel 56, the main platform panel 58 hingedly extends along fold line 63 from the bottom of the second platform panel 57, and the third platform panel 59 hingedly extends along fold line 64, which can be perforated, from the bottom of the main platform panel 58. Panels 57 and 58 are substantially rectangular. The length of panels 56 and 58 is substantially the same and is equal to about two-thirds the width of panel 12. The length of panel 57 is less than the length of side panel 16. The length of panel 59 is less than the length of panel 57.

An article receiving aperture 66 is located in main platform panel 58 and has the top edge shown in FIG. 1 coincident with fold line 63. This aperture 66 is substantially rectangular in shape and is defined by, as seen in FIG. 1, a top edge 77, a bottom edge 78 and two opposed side edges 79 and 80. Edge 77 is coincident with fold line 63. The aperture is substantially centered between the edges of panel 58 and extends upwardly about one-third of the length of panel 58.

The third panel 59 has adhesive 65 thereon and has a free or distal edge designated 65.

Referring again to the first platform panel 56, it is seen in FIG. 1 that the width of that panel is the same as the width of the second side panel 16 over a portion of the length thereof, with there being a recess defined on the left side thereof with a locking flange defined by edges 68 and 69, which are the mirror images of edges 51 and 52 described above. The recess in the entire series of platform panels extends along a straight edge designated 70 from edge 69 to about the mid-point of the third platform panel 59 in which a further recess is defined by edges 71 and 72 which have an angle of about 135° therebetween. This indentation or recess formed by edges 71 and 72 is so that in the ultimately formed container tuck flap 84, to be described below, does not interfere with panel 59.

Referring once again to the first platform panel 56, the right side edge 73 thereof is substantially a continuation of fold line 24 except that it extends into a recessing edge 74 at an angle of about 135°, edge 74 intersecting with fold line 62. From edge 74, the remaining panels 57, 58 and 59 all have a common straight edge designated 75 extending all the way to distal edge 65 on panel 59.

Referring now to the right hand side of FIG. 1, the rear panel 14 has a top closure flap 82 hingedly extending along fold line 83 from the top thereof, and that flap has a tuck flap 84 hingedly extending along fold line 85 from the top thereof which is parallel to line 83. The rear panel top closure flap 82 is substantially rectangular and has a width equal to the width of the rear panel and a length substantially equal to the width of side panel 16. Located along the right side edge of flap 82 are two spaced V-shaped notches 87 and 88 which are connected by a perforated semi-circular line 89, defining a tab area 90 therebetween.

The combination of the three top closure flaps 28, 48 and 82 provide a top closure for the container formed from blank 10, with flap 82 being the outermost closure flap. The fold lines 29, 49 and 83 for these top closure flaps are perpendicular to fold lines 22–24 and extend in the same straight line.

The rear panel 14 also has a bottom closure flap 92 hingedly extending along fold line 93 from the bottom thereof. This flap is substantially rectangular and is the same size as top closure flap 82. A locking flap 94 hingedly extends along fold line 95 from the bottom of flap 92, which locking flap has opposed cut lines 96 and 97 extending inwardly from opposed ends of fold line 95.

The three bottom closure flaps 31, 56 and 92 form the bottom closure for the container to be formed from blank 10, with flap 92 being the outermost closure flap on the bottom. The fold lines 32, 61 and 93 for these bottom closure flaps are perpendicular to fold lines 22–24 and extend in the same straight line.

Once the blank is formed, advantageously by die cutting, in the configuration shown in FIG. 1, this blank can be folded, with adhesive added in appropriate places, so that a sleeve configuration is attained by means of only three folds. Once the sleeve configuration is attained, the sleeve, in the non-expanded, flat state, can be stored in stacks until use is required. Then, the sleeve is expanded to form a rectangular chamber, the platform is manipulated to its receiving position, the bottom closure flaps are closed, the article is placed in the container and the top closure flaps are closed.

Figure 2:
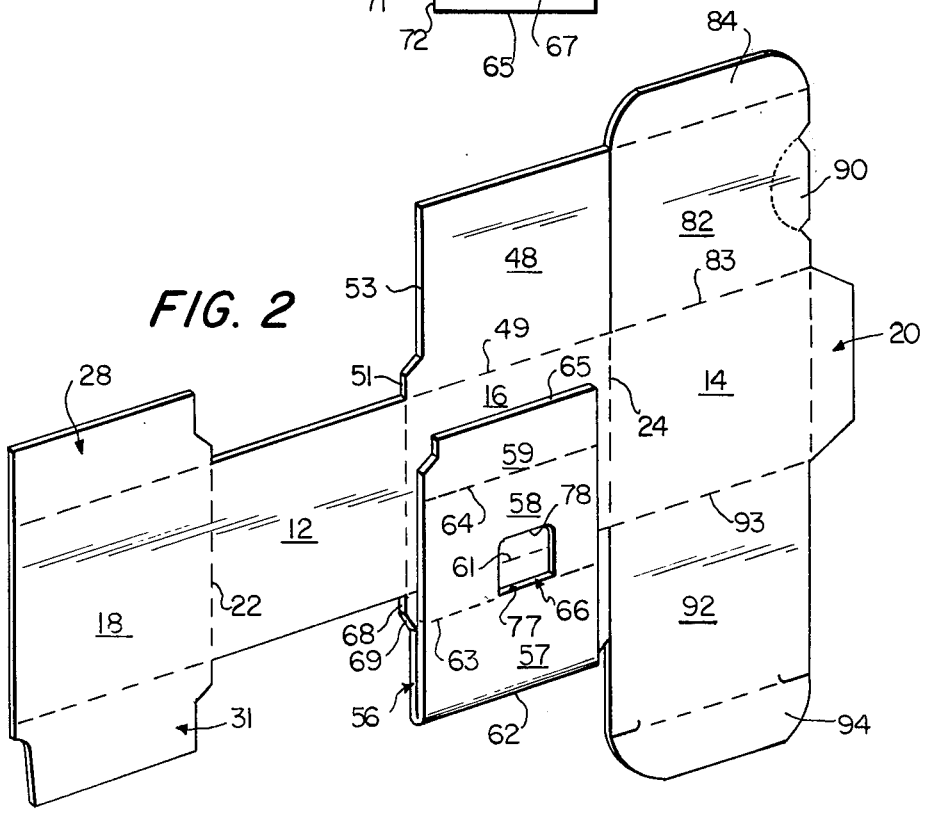
FIG. 2 is a right perspective view of the blank shown in FIG. 1, except that the second, main and third platform panels have been folded back against the side panel from which they extend and the third platform panel has been adhered thereto.
Figure 3:
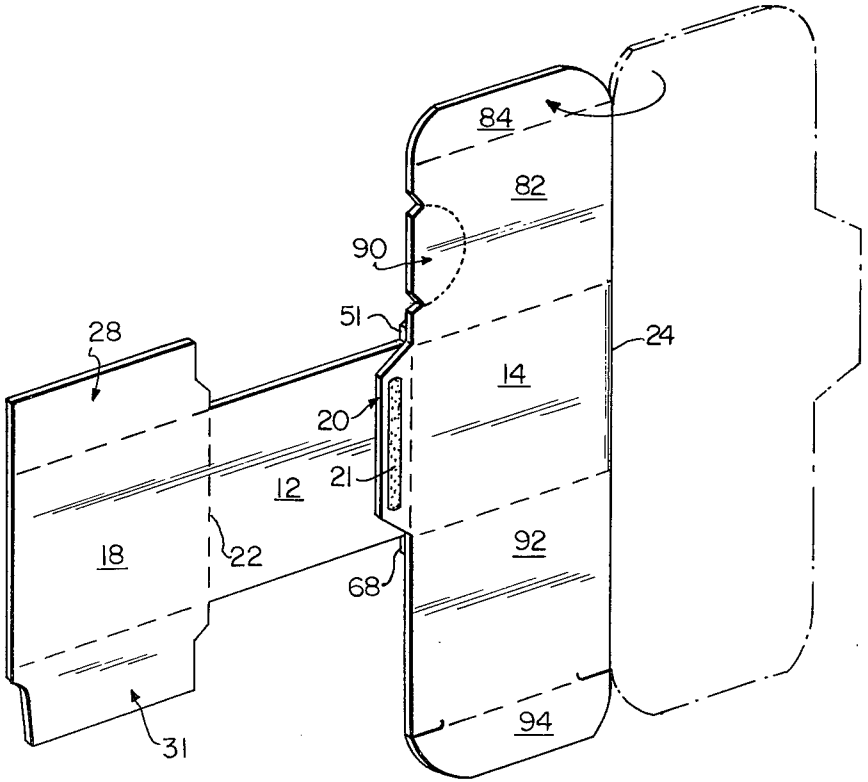
FIG. 3 is a right perspective view of the blank shown in FIG. 2, except that the rear panel and its top and bottom closure flaps have been folded from a position shown in solid lines in FIG. 2 and in phantom lines in FIG. 3 to a position shown in solid lines overlying the platform panels, adhesive being added to the glue flap thereon.

In order to obtain this non-expanded, flat sleeve configuration, the following steps are followed, as shown in FIGS. 2–4.

First, adhesive is interposed between the first side panel 16 and the third platform panel 59, such as by placing adhesive 67 on panel 59, and the three outermost platform panels 57, 58 and 59 are folded up and back over first panel 56 and second side panel 16 only along fold line 62. This is shown in FIG. 2. Rather than placing adhesive on panel 59, the adhesive can be placed on panel 16 in a position to adhere panel 59 and panel 16.

The next step, which is shown in FIG. 3, includes a folding of the rear panel 14 along fold line 24 between that rear panel and side panel 16. Upon folding of rear panel 14, the top closure flap 82 and the bottom closure flap 92 associated therewith also are pivoted around fold line 24 so that flap 82 is adjacent the facing side of flap 48 and flap 92 is adjacent the outer faces of panels 57, 58 and 59. Either at the beginning of that folding motion or upon its completion, adhesive is added to glue flap 20 as seen in FIG. 3 and designated 21.

The final folding operation or step, comprises a folding around fold line 22 of the second side panel 18. This is shown in FIG. 4 in which the side panel 18 contacts and overlaps with the glue flap 20 so that adhesive 21 adheres panel 18 to flap 20. Of course, adhesive could be added to the side panel 18 in an area which would adhere that panel to flap 20. In this configuration shown in FIG. 4, the side panel 18 overlies and faces the front panel 12.

Moreover, this final, third fold completes the formation of the sleeve, without additional operations. This folding operation can be expeditiously done by high speed, automated machines.

In order to utilize the container to support an article, the sleeve is expanded by maneuvering the panels so that there is a folding along fold line 25 between the glue flap 20 and rear panel 14 and fold line 23 between front panel 12 and side panel 16. This is accomplished by exerting opposed pressure on the sleeve in the areas of fold lines 22 and 24 as seen in FIG. 4.

The resulting expanded sleeve is shown in FIG. 5. This sleeve has a rectangular cross section, both longitudinally and transversely, and defines a chamber 99 therein. Panels 12, 14, 16 and 18 are planar with panels 12 and 14 being parallel and with panels 16 and 18 being parallel and perpendicular to panels 12 and 14.

In order to set the platform up in a position so as to receive an article, pressure is applied to fold line 62, as seen in FIGS. 2 and 5, upwardly so that main platform panel 58 and first platform panel 56 are pivoted to a position substantially perpendicular to side panel 16 and substantially perpendicular to the second platform panel 57 therebetween. Similarly, the first or support platform panel 59 is substantially perpendicular to the main platform panel 58, and parallel to the second platform panel 57. This movement of the various platform panels is accomplished by respective pivoting about fold lines 64, 63, 62 and 61.

In addition, the bottom closure flap 31 associated with the second side panel 18 is pivoted along fold line 32 to a position in which it is perpendicular to panel 18 and contacts the bottom of the first platform panel 56, as seen in FIG. 5.

To completely close the bottom of the container shown in FIG. 5, the bottom closure flap 92 is pivoted along fold line 93 to a position perpendicular to rear panel 14 and locking flap 94 is pivoted about fold line 95 to a position perpendicular to flap 92. Then, locking flap 94 is maneuvered between edge 42 of the bottom closure flap 31 and the inside surface of front panel 12.

This is shown in FIG. 6 in which the locking flap 94 is locked in place by having the locking flanges defined respectively by edges 68 and 69 on panel 56 and edges 40 and 41 on flap 31 received in cut lines 97 and 96.

With the bottom securely closed on the container and the platform in a position to receive an article, the article, such as a light bulb, is maneuvered into chamber 99 so that the base of the bulb passes into and is received in aperture 66, as seen in FIG. 15 regarding the blank 124 of FIG. 10.

The top closures can now be manipulated to fully close the container with the article therein. This closing as seen in FIG. 7 is initiated by folding in the top closure flaps 28 and 48 to a position substantially perpendicular to side panels 16 and 18. To complete this, tuck flap 84 is folded along fold line 85 to a position substantially perpendicular to top closure flap 82, as seen in FIG. 7, and then flap 82 is folded along fold line 83 so that it is substantially perpendicular to rear panel 14. In doing this, the tuck flap 84 is received between front panel 12 and the now folded top closure flaps 28 and 48. Specifically, flap 84 is interposed between front panel 12 and edges 51 and 36 of flaps 28 and 48. If desirable, cut lines, similar to those shown associated with flap 94, can be associated with flap 84 to allow a positive locking by receipt in those cut lines of the flanges formed by edges 51 and 52 with regard to flap 48 and edges 36 and 37 with regard to flap 28.

Referring now to FIG. 8, a modified article receiving aperture 66' is shown formed in a blank the same as blank 10 shown in FIG. 1, with like portions having the same character numerals. The article receiving aperture in this embodiment is intended to receive an article, such as a light bulb, which has a projection transversely extending from the base thereof. As seen in FIG. 8, the aperture 66' is formed both in the main platform panel 58' and the second platform panel 57', so that the aperture formed in panel 58' continues into the aperture formed in panel 57'. Thus, the aperture thereby formed spans fold line 62' between panels 57' and 58'. The aperture 66' has an irregular shape and comprises a curvilinear portion 105 in the form of an arc of a circle and a plurality of straight edges 106, 107, 108, 109, 110, 111 and 112. Edge 106 extends downwardly from the end of curvilinear portion 105, edge 107 is perpendicular to edge 106, edge 108 extends upwardly perpendicular to edge 107, edge 109 extends horizontally and perpendicularly to edge 108, edge 110 extends upwardly and perpendicularly to edge 109, edges 111 and 112 form a V-shaped notch extending between the end of edge 110 and the other end of curvilinear portion 105. Fold line 63' extends through curvilinear portion 105 and also extends through the intersection of edges 111 and 110. Edge 106 is substantially in the middle of the width of panel 57' and the center of the circle from which curvilinear portion 105 is derived is spaced to the left of the center line of panel 57', which center line is perpendicular to fold line 63'. The diameter of that circle is about one-half the width of panel 58'. The uppermost extent of the cirvilinear portion 105 seen in FIG. 8 along panel 58' is about one-half the length of that panel; and the lowermost extent of edge 106 in panel 57' is about one-half the length of that panel.

Referring now to FIG. 9, another modified aperture, designated 66'' is shown for receiving an article therein. This aperture 66'' is also formed in a blank similar to blank 10 shown in FIG. 1, the only difference being in the aperture and its parts, with like parts having the same character numerals.

As seen in FIG. 9, aperture 66'' is polyagonal with six sides and is formed at the top by an inverted U-shaped portion 116 with diverging legs and at the bottom by a portion 117 having the outline of an isosceles trapezoid, with the smaller base on the bottom thereof and coincident with fold line 63. Two tabs 118 and 119 having an inverted U-shape extend inwardly into the aperture from each of the legs of portion 116 along a fold line. A third tab 120 also having an inverted U-shape extends inwardly from portion 117 having a fold line coincident with fold line 63. These tabs aid in gripping the base of an article, such as a light bulb, supported in aperture 66". This aperture 66" is centered along the width of panel 58" and extends upwardly from fold line 63 about two-thirds the length of panel 58". The largest width of the aperture, at the intersections of portions 116 and 117 is about one-half the width of panel 58".

Referring now to FIG. 10, a modified blank 124 is shown which is similar to that shown in FIG. 1; however, the series of platform panels extend from the front panel, rather than from one of the side panels. In addition, the outermost top and bottom closure flaps are modified, as are the top and bottom closure flaps associated with the side panels.

As seen in FIG. 10, the blank 124 is also preferably formed of thin, foldable paper board or cardboard. The blank is comprised of a front panel 125, a rear panel 127, a first side panel 129 and a second side panel 131, all of which are rectangular and are hingedly connected respectively along parallel fold or hinge lines 134, 135 and 136. These fold lines are preferably formed in the blank by means of a light scoring. In addition, a glue flap 133 hingedly extends along fold line 137 from the distal edge of rear panel 127. Fold line 137 is parallel to fold lines 134–136. Of course, this glue flap could also extend from the distal or exterior edge of the second side panel 131 as shown in FIG. 10. These four panels have the same length, which is the vertical distance seen in FIG. 10, and substantially the same width.

The second side panel 131 has a top closure flap 139 which is substantially rectangular extending along fold line 140 from the top of panel 131. This flap 139 is recessed on its right hand side to define a locking flange 151 having an edge coincident with fold line 134. The width of flap 139 between flange 151 and the left side edge is equal to the width of panel 131. The length of flap 139 is substantially equal to the width of panel 125.

A bottom closure flap 141 in the form of a right trapezoid extends from the bottom of panel 131 along fold line 142, fold line 142 forming the larger base of the trapezoid. The width of flap 141 at its largest extent is equal to the width of panel 131 and the length thereof at its largest extent is slightly less than one-half the width of panel 125.

The first side panel 129 has similar top and bottom closure flaps associated therewith including top closure flap 144 hingedly extending along fold line 145 from the top thereof and bottom closure flap 147 hingedly extending from the bottom thereof along fold line 148. These closure flaps are mirror images of flaps 139 and 141 and flap 144 has associated therewith locking flange 152.

The rear panel 127 has a top closure flap 154 hingedly extending from the top thereof along fold line 155, and flap 154 has hingedly extending along the fold line 157 at the top thereof a locking flap 156, having cut lines 158 and 159 extending inwardly along fold line 157. The length of flap 154 is substantially equal to the width of panel 129, and the width of flap 154 is substantially the same as the width of panels 125 and 127. Flap 154 is substantially rectangular.

The rear panel 127 also has a bottom closure flap 161, which is rectangular and which extends hingedly from the bottom of panel 127 along fold line 162. At the distal edge 164 on the bottom of flap 161 there is a strip of adhesive 163. The width of flap 161 is substantially the same as the width of panels 125 and 127 and the length of flap 161 is about equal to the width of side panels 129 and 131.

The top closure flaps 139, 144 and 154 form the top closure for the container to be formed by blank 124 and flaps 141, 147 and 161 form the bottom closure for the container so formed. Flaps 154 and 161 are the outermost closure flaps therefor. The fold lines 140, 145 and 155 for the top closure flaps are in a straight line and are parallel to fold line 176 and fold lines 142, 148 and 162 for the bottom closure flaps, all of these being perpendicular to fold lines 134–137. Fold lines 142, 148, 162 and 176 are in a straight line.

As seen in FIG. 10, a series of platform panels, similar to those discussed above regarding FIG. 1, extend from the front panel 125 along parallel fold lines. These include a first platform panel 168, a second platform panel 169, a main platform panel 170 and a third platform panel 171. An article receiving aperture 172 is formed in panel 170 with the top most edge, as seen in FIG. 10, being coincident with a fold line 178 between panels 169 and 170. This aperture is substantially rectangular.

The first platform panel 168 hingedly extends along fold line 176 from the bottom of the front panel 125 and the second platform panel hingedly extends along fold line 177 at the bottom of panel 168. The main platform panel 170 hingedly extends along fold line 178 from the bottom of the second platform panel 169 and the third platform panel 171 hingedly extends from the bottom of panel 170 along fold line 179. The distal edge 174 of panel 171 has adjacent thereto adhesive 173. These fold lines 176–179 are all parallel and panels 169, 170 and 171 are substantially rectangular. Panels 169 and 171 are substantially the same size and panels 169-171 all have the same width, which is slightly less than the width of panel 125.

The first panel 168 has a first portion between straight, parallel opposed side edges 181 and 183, which are extensions respectively of fold lines 134 and 135, which is equal to the width of panel 125; however, the width of panel 168 tapers from edges 181 and 183 along opposed straight side edges 182 and 184 which end at fold line 177. From there, the opposed edges 187 and 188 of panels 169, 170 and 171 are parallel. Thus, a portion of the first panel 168 has the same width as panel 125, while another portion has a width less than the width of panel 125. The lengths of panels 168 and 170 are the same and are less than the width of side panels 131 and 129.

As seen in FIGS. 11–13, the blank 124 can be folded via three folding steps into a substantially flat sleeve configuration, similar to that described above regarding the blank of FIG. 1. The first fold is along the fold line 177 in which panels 169, 170 and 171 are pivoted thereabout into contact with panels 168 and 125. Adhesive 173 is interposed between panel 171 and 125 to adhere these panels together. The adhesive 173 can be on panel 171 as seen in FIG. 10 or on panel 125 in the appropriate position. This folded position is shown in FIG. 11.

As seen in FIG. 12, the combination of the rear panel 127 and top and bottom closure flaps 154 and 161 are next folded about fold line 136 so that panel 127 overlies panel 129 and flaps 154 and 161 respectively overlie flaps 144 and 147. In addition, glue flap 133 overlies a portion of panels 170 and 171, with adhesive 138 being applied to glue flap 133.

As seen in FIG. 13, the combination of side panel 131 and top and bottom closure flaps 139 and 141 are next pivoted about fold line 134 so that panel 131 is in contact with glue flap 133. The adhesive 138 could also be applied to the appropriate area on side panel 131. In all events, the glue flap 133 and side panel 131 are adhered together in the position shown in FIG. 13.

In order to expand the sleeve so formed, pressure is exerted inwardly along the fold lines 134 and 136, as seen in FIGS. 13 and 14, resulting in an expansion of the sleeve to define a chamber 186 having longitudinal and transverse rectangular cross sections. This expansion is accomplished by means of folding along fold lines 137 and 135, as well as a folding along fold lines 134 and 136.

As seen in FIG. 14, an upward pressure on fold line 177 provides for a folding of the platform panels about fold lines 176–179, resulting in a configuration in which panel 171 is substantially perpendicular to the main platform panel 170, panel 170 is substantially perpendicular to panel 169 and panel 169 is substantially perpendicular to panel 168. Similarly, panel 169 is perpendicular to front panel 125 and parallel to panels 125 and 171.

In addition, the bottom closure flaps 141 and 147 are folded to a position perpendicular respectively to panels 129 and 131 along fold lines 142 and 148. These closure flaps are in contact with the bottom of panel 168 as seen in FIG. 14.

To fully close the bottom of the container shown in FIG. 14, the bottom closure flap 161 is folded along line 162 and adhesive 163 adheres this flap 161 to flaps 141 and 147 as seen in FIG. 15.

After the article to be received by aperture 172 is received therein, the top closure flaps 139, 144 and 154 can be folded along their respective fold lines, with flap 154 being the outermost closure flap.

This is shown in FIG. 15, in which flap 139 has been first folded perpendicular to panel 131 and then flap 144 has been folded perpendicular to panel 129. Locking flap 156 is folded along fold line 157 to a position perpendicular to flap 154 and flap 154 is itself folded along line 155 to a position perpendicular to rear panel 127.

As shown in FIG. 15, an article in the form of a light bulb 189, shown in phantom, is received in aperture 172 and is fully enclosed in the chamber 186 formed by the container but spaced from the outer panels thereof.

The top closure flap 154 is locked in this position by means of locking flanges 151 and 152 being received respectively in cut lines 158 and 159 along fold line 157.

Referring now to FIGS. 16–18, a modified bottom closure is shown on a blank similar to that shown in FIG. 10 with like parts having the same character numerals.

Specifically, the modified bottom closure flap 161' associated with rear panel 127 has a centrally located tuck-in lock tab extending hingedly along fold line 191 at the bottom of the flap, with cut lines 192 and 193 extending inwardly along fold line 191.

In addition, a straight receiving cut line 194 is formed in first platform panel 168' and has two small outwardly extending straight legs at the ends thereof crossing fold line 176' between front panel 125' and the first platform panel 168' and extending into panel 125'.

As seen in FIGS. 17 and 18, the lock tab 190 is folded around fold line 191 so that it is perpendicular to flap 161' and, with that flap 161' being folded perpendicularly about fold line 162 relative to rear panel 127, tab 190 is received in and locked in cut line 194. Prior to the folding of flap 161', the two top closure flaps 141 and 147 associated with side panels 131 and 129 are folded inwardly, similar to that shown in FIG. 14. Thus, flap 161' is the outermost flap. This flap is securely connected and locked in the closed position by means of cut lines 192 and 193 receiving portions of the material forming panels 125' and 168' adjacent cut line 194.

Referring to FIGS. 19–21, a blank similar to that shown in FIG. 10 is illustrated with a second modification of the bottom closure structure, like parts having the same character numerals.

Specifically, the bottom closure flap 161'' associated with the rear panel 127 is in the form of an isosceles trapezoid in which fold line 162 is the longer base, and opposed edges 195 and 196 extend from opposite ends of fold line 162 and converge into distal edge 197. Thus, this flap 161'' tapers as it extends outwardly from the fold line. Edge 197 and fold line 162 are substantially parallel, and the angles between edge 195 and fold line 162 and between edge 196 and fold line 162 are each about 65°.

The first platform panel 168'' has a central receiving cut line 198 therein formed of a straight line 200 and two short inwardly extending cut lines 201 and 202, extending downwardly from opposed ends thereof. These extend at angles of about 45° and end in a fold line 199 parallel to line 200. Line 200 is parallel to fold lines 176 and 177 on opposite ends of platform panel 168'', with fold line 199 being approximately spaced from fold line 177 about one-quarter the length of panel 168''. Cut line 200 is above fold line 177 about three-eights the overall length of panel 168''.

As seen in FIGS. 20 and 21, once the platform panel 168'' has been folded along line 176 to a position perpendicular to panel 125, and bottom closure flaps 141 and 147 are also folded perpendicular to their respective side panels along fold lines 142 and 148, the distal edge 197 is maneuvered through and received by the receiving cut line 198 to fully close the bottom of the container shown therein. As seen in FIG. 21, the bottom closure flaps 141 and 147 overlie panel 168'' and flap 161'' overlie flaps 141 and 147. This embodiment is advantageous since it uses less board.

While advantageous embodiments have been chosen to illustrate the present invention, it will be understood by those skilled in the art that various changes and modifications can made therein without departing from the scope of the invention as defined in the appended claims.

What is claimed is:

1. A unitary blank adapted to be formed into a carton having an internal platform for supporting an article comprising:

a front panel, first and second side panels and a rear panel hingedly connected along parallel fold lines;

a glue flap hingedly extending along a fold line from one of said rear panels and said side panels;

a bottom closure flap hingedly extending along a fold line from the bottom of at least one of said front and rear panels;

at least one top closure flap hingedly extending along a fold line from the top of one of said panels;

a series of four consecutively arranged platform panels hingedly connected along parallel fold lines, said series comprising a first platform panel hingedly extending along a fold line from one of said side panels, a second platform panel hingedly extending along a fold line from said first platform panel, a main platform panel hingedly extending along a fold line from said second platform panel and having an article receiving aperture therein, and a third platform panel hingedly extending along a fold line from said main platform panel, and a bottom flap panel extending from a fold line from the bottom of the other of said side panels.

2. A blank according to claim 1, wherein said second platform panel has a length less than the length of the panel from which said series extends.

3. A blank according to claim 1, wherein said first and second platform panels each has a length less than the width of each panel adjacent the panel from which said series extends.

4. A blank according to claim 1, wherein said rear panel has a top closure flap extending therefrom.

5. A blank according to claim 1, wherein said rear panel has a bottom closure flap extending therefrom.

6. A blank according to claim 1, wherein said side panels both have a top closure flap extending therefrom.

7. A blank according to claim 1, wherein at least one of said side panels has a top closure flap extending therefrom.

8. A blank according to claim 1, wherein a top closure flap extends from each of said side panels.

9. A blank according to claim 1, wherein said first platform panel has a width for a portion of its length substantially equal to the width of the panel from which it extends.

10. A blank according to claim 1, wherein said first platform panel has a width for a portion of its length less than the width of the panel from which it extends.

11. A blank according to claim 1, wherein said series of platform panels hingedly extends from one of said side panels.

12. A blank according to claim 11, wherein said second, main and third platform panels each has a width less than the width of the side panel from which said series extends.

13. A blank according to claim 1, wherein said series of platform panels hingedly extends from said front panel.

14. A blank according to claim 1, wherein said second, main and third platform panels each has a width less than the width of said front panel.

15. A blank according to claim 1, wherein said article receiving aperture is substantially rectangular.

16. A blank according to claim 1, wherein said article receiving aperture extends into said second platform panel.

17. A blank according to claim 1, wherein said article receiving aperture is polygonal.

18. A blank according to claim 1, wherein said article receiving aperture has at least one tab extending inwardly from a side thereof along a fold line.

19. A blank according to claim 1, wherein said at least one bottom closure flap has a locking flap extending along a fold line from the end thereof, and said first platform panel has a cut line therein.

20. A blank according to claim 1, wherein said at least one bottom closure flap is substantially rectangular.

21. A blank according to claim 1, wherein said at least one bottom closure flap is in the form of an isosceles trapezoid, and said first platform panel has a cut line therein having a length greater than the distal edge of said at least one bottom closure flap.

22. A unitary blank adapted to be formed into a carton having an internal platform for supporting an article comprising:

a front panel, first and second side panels and a rear panel hingedly connected along parallel fold lines;

a glue flap hingedly extending along a fold line from one of said rear panel and said side panels;

a first and second bottom closure flap respectively hingedly extending along corresponding fold lines from the bottom of two of said panels, and a third bottom closure flap hingedly extending along a fold line from the bottom of a third one of said panels;

at least one top closure flap hingedly extending along a fold line from the top of one of said panels; and a series of four consecutively arranged platform panels hingedly connected along parallel fold lines, said series comprising a first platform panel hingedly extending along a fold line from one of said side panels, a second platform panel hingedly extending along a fold line from said first platform panel, a main platform panel hingedly extending along a fold line from said second platform panel and having an article receiving aperture therein, and a third platform panel hingedly extending along a fold line from said main platform panel.

23. A container comprising:

a front wall, first and second side walls, and a rear wall hingedly connected along generally parallel fold lines to define a tube;

means hingedly coupled with the upper edges of one of said walls for enclosing the top of said tube;

a platform assembly within said tube including (1) a first support panel hingedly connected to the lower edges of one of said walls and extending only part way into said tube toward another of said walls opposing said one wall, (2) a second support panel hingedly connected to said first panel and extending upwardly toward said enclosing means, (3) a main platform panel hingedly connected to said second support panel and extending toward said one wall, (4) a third support panel hingedly connected to said main platform and secured to said one wall, and (5) a flap member hingedly connected to lower edges of said another wall and extending toward said one wall, said flap member extending beyond said second support panel and disposed in underlapping, abutting relationship to said first support panel; and a closure flap hingedly connected along the lower edges of said rear wall and extending toward said front wall in underlapping relationship to said flap member and said first support panel.

24. A container according to claim 23, wherein said main platform panel includes an article receiving aperture therein.

25. A container according to claim 23, wherein said one wall and said second and third panels are essentially parallel to each other, and said main platform and said first support panel are essentially parallel to each other.

26. A container according to claim 23, wherein:

the edges of said first and second support panels and said flap member adjacent said front wall are spaced from said front wall to define a flap receiving slot within said tube, and said closure flap is provided with a locking flap hingedly connected to the free outer extremity thereof, said locking flap being inserted into said receiving slot.

* * * * *